US008230894B2

(12) United States Patent
Huang

(10) Patent No.: US 8,230,894 B2
(45) Date of Patent: Jul. 31, 2012

(54) ADHESIVE TAPE DISPENSER

(76) Inventor: Harrison Huang, Taichung County (TW)

( * ) Notice: Subject to any disclaimer, the term of this patent is extended or adjusted under 35 U.S.C. 154(b) by 317 days.

(21) Appl. No.: 12/707,694

(22) Filed: Feb. 18, 2010

(65) Prior Publication Data

US 2011/0139374 A1 Jun. 16, 2011

(51) Int. Cl.
*B65H 35/07* (2006.01)
*B32B 37/10* (2006.01)

(52) U.S. Cl. ..... 156/577; 156/579

(58) Field of Classification Search ..... 156/574, 156/577, 579
See application file for complete search history.

(56) References Cited

U.S. PATENT DOCUMENTS 5,110,401 A * 5/1992 Huang ..... 156/527
5,197,386 A * 3/1993 Lin ..... 101/213
5,792,312 A * 8/1998 Dotterman et al. ..... 156/579
6,257,298 B1 * 7/2001 Huang ..... 156/577
6,296,033 B1 * 10/2001 Clements ..... 156/527
7,343,954 B2 * 3/2008 Yanagida et al. ..... 156/579
2002/0023722 A1 * 2/2002 Mistyurik et al. ..... 156/384
2003/0116284 A1 * 6/2003 Downs et al. ..... 156/541
2007/0235143 A1 * 10/2007 Wermuth ..... 156/577
2008/0067211 A1 * 3/2008 Steele et al. ..... 225/77

* cited by examiner

*Primary Examiner* — Mark A Osele
(74) *Attorney, Agent, or Firm* — Browdy and Neimark, PLLC

(57) ABSTRACT

An adhesive tape dispenser, to which a tape roll having a roll of an adhesive tape can be mounted and which is composed of a main body, a tape roll holder, and a pressing roller. The main body includes a handgrip, a protective wall connected with the handgrip, and an assembly member. A receiving space is formed between the handgrip and the protective wall. The protective wall has a contact surface formed at one side thereof opposite to the other side thereof facing the handgrip. The tape roll holder is mounted to the assembly member and includes a rotatable member for installing the tape roll thereto. The pressing roller is mounted to the main body and includes a rolling member which is rotatable relative to the main body for rolling the adhesive tape pulled out from the tape roll.

9 Claims, 8 Drawing Sheets

ADHESIVE TAPE DISPENSER

BACKGROUND OF THE INVENTION

1. Field of the Invention

The present invention relates generally to a tape dispenser, and more particularly to an adhesive tape dispenser, which may protect the user's hand and even an object during dispensing.

2. Description of the Related Art

While operating a conventional adhesive tape dispenser, a user's hand usually collides with an object being packaged, such that the user's hand may get hurt.

Before an opening of the object is sealed by an adhesive tape, where the opening of the object is being sealed may be uneven, such that the conventional adhesive tape dispenser fails to smoothly attach the adhesive tape dispensed therefrom on it to roughen the adhesive tape thereon.

Besides, the conventional adhesive tape dispenser did not have any means for hanging itself on the user, such that the user usually has to put it into his or her tool bag to feel inconvenient while carrying and taking it out of the tool hag for operation.

In other words, the conventional adhesive tape dispenser still has several disadvantages for further improvement.

SUMMARY OF THE INVENTION

The primary objective of the present invention is to provide an adhesive tape dispenser, which can effectively protect the user's hand from injury and even a surface of an object, before dispensing the adhesive tape on the object, to allow the adhesive tape to be smoothly attached to the surface.

The secondary objective of the present invention is to provide an adhesive tape dispenser, which can be hung on the user for carrying and operating convenience.

The foregoing objectives of the present invention are attained by the adhesive tape dispenser, to which a tape roll having a roll of an adhesive tape can be mounted and which is composed of a main body, a tape roll holder, and a pressing roller. The main body includes a handgrip, a protective wall connected with the handgrip, and an assembly member. A receiving space is formed between the handgrip and the protective wall. The protective wall has a contact surface formed at one side thereof opposite to the other side thereof facing the handgrip. The tape roll holder is mounted to the assembly member and includes a rotatable member for installing the tape roll thereto. The pressing roller is mounted to the main body and includes a rolling member which is rotatable relative to the main body for rolling the adhesive tape pulled out from the tape roll.

In the present invention, the protective wall includes an arc-shaped surface formed at least one of two ends thereof.

In the present invention, the handgrip is composed of a first shell and a second shell.

In the present invention, the protective wall is connected with the first shell.

In the present invention, the second shell is covered onto an upper side of at least one part of the protective wall.

In the present invention, the adhesive tape dispenser further includes a hanging auxiliary having a hanging bar detachably fixed to the receiving space of the main body. The hanging auxiliary further has a hanging portion for hanging the hanging auxiliary on an object. The hanging auxiliary is rotatable for a predetermined angle relative to the main body. The hanging auxiliary further has a stopping portion for not stopping or stopping the hanging auxiliary from separation from the main body, while the main body is located at a first angle or a second angle, in such a way that the hanging auxiliary is inseparable or separable from the main body. When the hanging auxiliary is separable from the main body, the stopping portion can be entered into or disengaged from the receiving space.

DETAILED DESCRIPTION OF PREFERRED EMBODIMENTS

Figure 1:
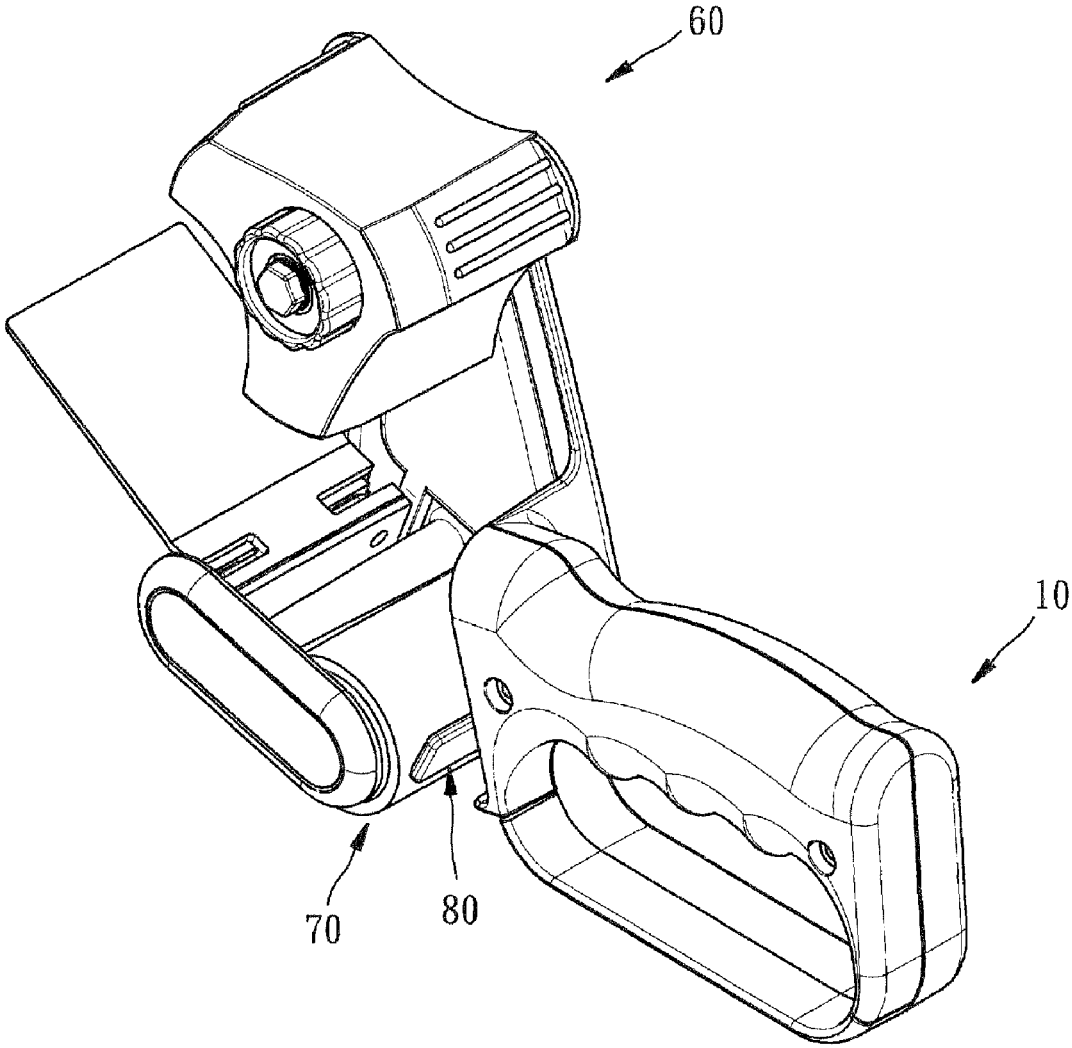
FIG. 1 is a perspective view of a first preferred embodiment of the present invention.
Figure 2:
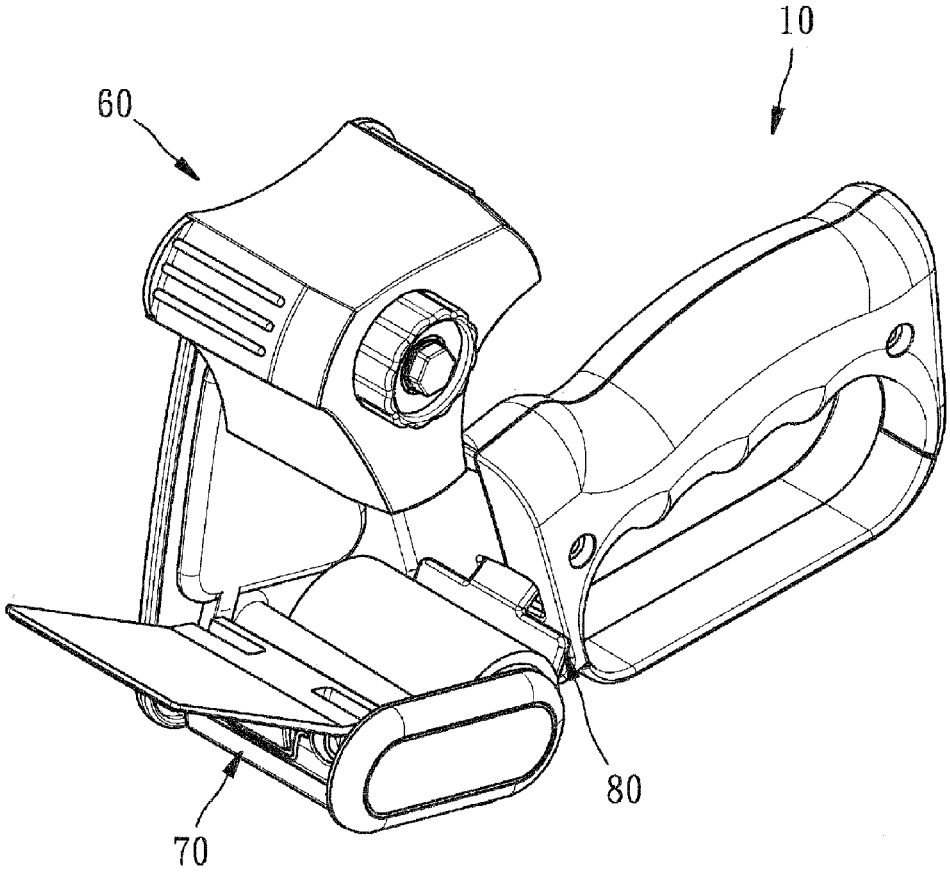
FIG. 2 is another perspective view of the first preferred embodiment of the present invention.
Figure 3:
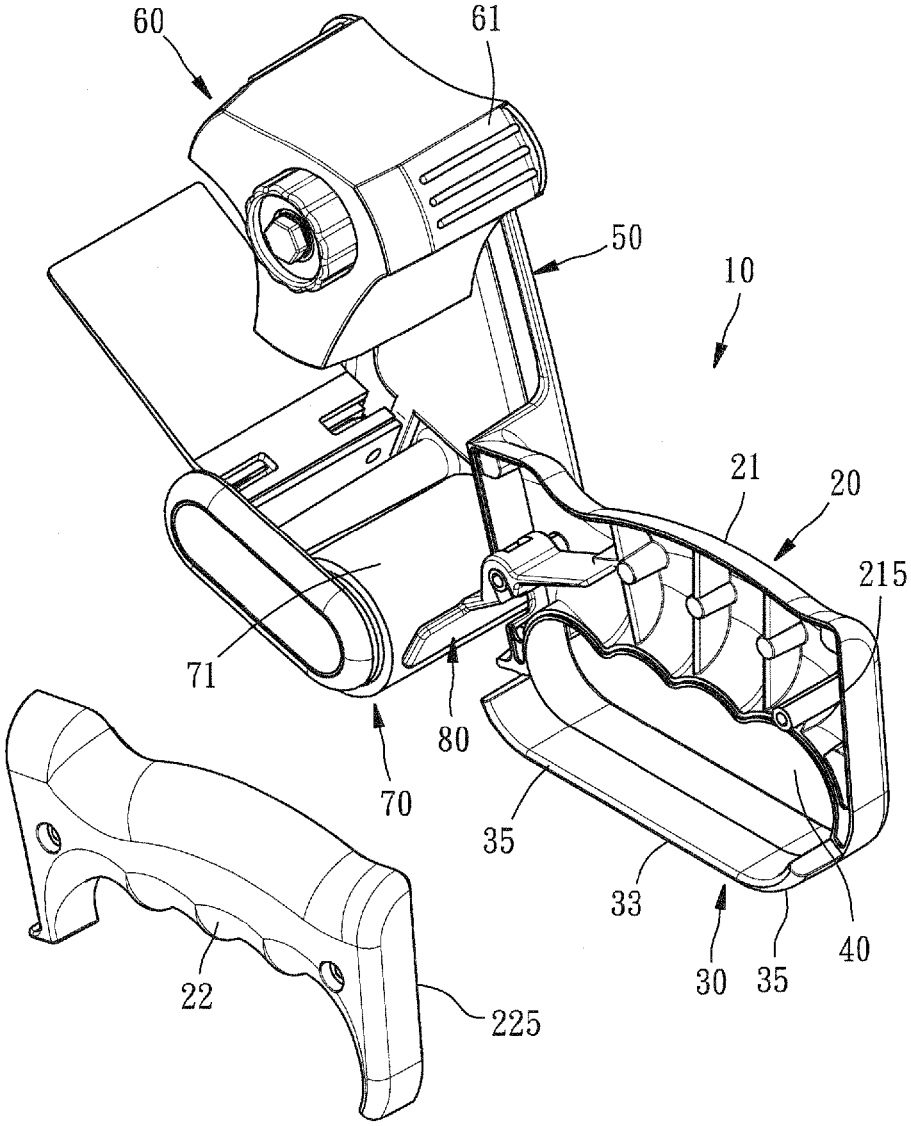
FIG. 3 is a partially exploded view of the first preferred embodiment of the present invention.
Figure 4:
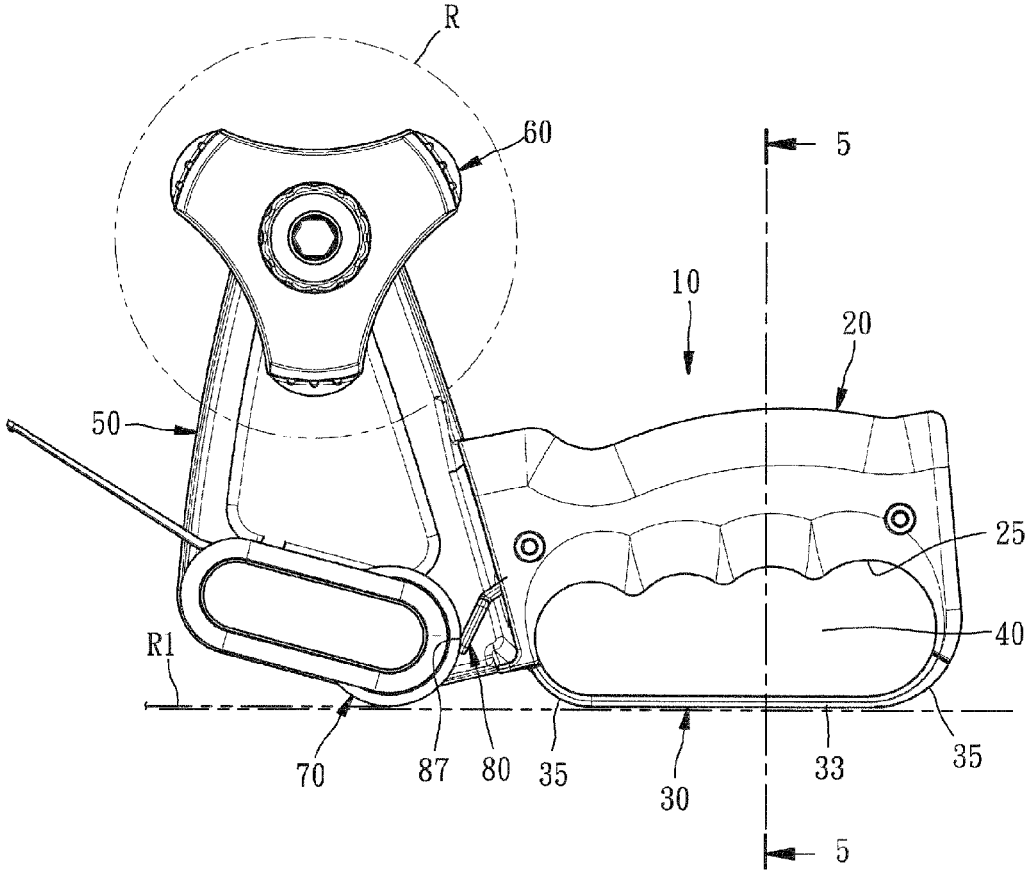
FIG. 4 is a front view of the first preferred embodiment of the present invention.
Figure 5:
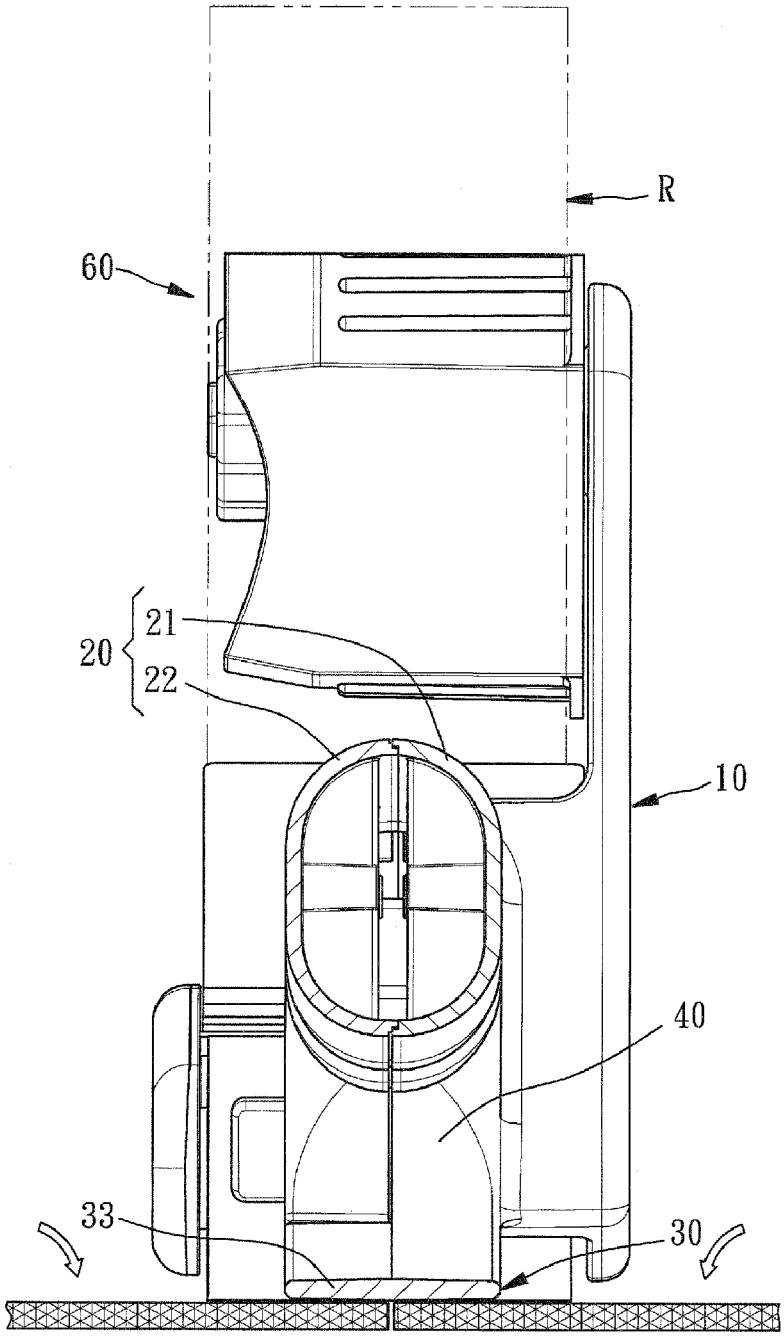
FIG. 5 is a sectional view taken from a line 5-5 indicated in FIG. 4.

Referring to FIGS. 1-5, an adhesive tape dispenser constructed according to a first embodiment of the present invention can be installed with a tape roll R having a roll of an adhesive tape R1 and is composed of a main body 10, a tape roll holder 60, a pressing roller 70, and a pressing member 80 as recited below.

The main body 10 includes a handgrip 20, a protective wall 30 connected with the handgrip 20, and an assembly member 50. A receiving space 40 is formed between the handgrip 20 and the protective wall 30. The protective wall 30 has a contact surface 33 formed at one side thereof opposite to the other side thereof facing the handgrip 20. The protective wall 30 is connected with the handgrip 20 and includes two arc-shaped portions 35, each of which is formed at one of front and rear ends thereof. The handgrip 20 is composed of a first shell 21 and a second shell 22. The protective wall 30 is mounted to the first shell 21.

The tape roll holder 60 is mounted to the assembly member 50 and includes a rotatable member 61, which is rotatable relative to the main body 10, for installing the tape roll R thereon.

The pressing roller 70 is mounted to a predetermined position of the main body 10 and includes a rolling member 71, which is rotatable relative to the main body 10, for rolling the adhesive tape R1 pulled out from the tape roll R.

The pressing member 80 is mounted to the handgrip 20 and includes a pressing contact end 87 for elastically pressing the adhesive tape R1 to a predetermined position of an external surface of the rolling member 70.

Although the adhesive tape dispenser further comprises a cutter and a clapper, which belong to prior art, such that their reference signs and detailed recitation are omitted hereto.

In detail, the first shell 21 is connected with the assembly member 50 in one piece. The second shell 22 is covered on at least one part of the protective wall 30. Besides, the first shell 21 further includes a coupling brim 215 and the second shell 21 also includes a coupling brim 225 connected with the coupling brim 215. The handgrip 20 further includes a plurality of recessed portions 25 having a variety of sizes and formed at one side thereof and abutting against the receiving space 40 for fitting the user's fingers to allow the user to hold the handgrip ergonomically.

When the user operates the adhesive tape dispenser of the present invention, the protective wall 30 of the main body 10 can fully encompass the user's fingers in the receiving space 40, such that the user's fingers can be well protected from injury.

Referring to FIG. 4 again, it happens that an imaginary extension line of the contact surface 33 of the main body 10 approximately is a tangent line of the rolling member 71. Therefore, the contact surface 33 can fully lie on and press an object being packaged, when the rolling member 71 presses the adhesive tape R1 for smoothness, to further speed up the packaging operation via the adhesive tape. The object is a carton, as an example in this embodiment, having two upper cardboards which can be opened or closed relative to the carton.

Figure 6:
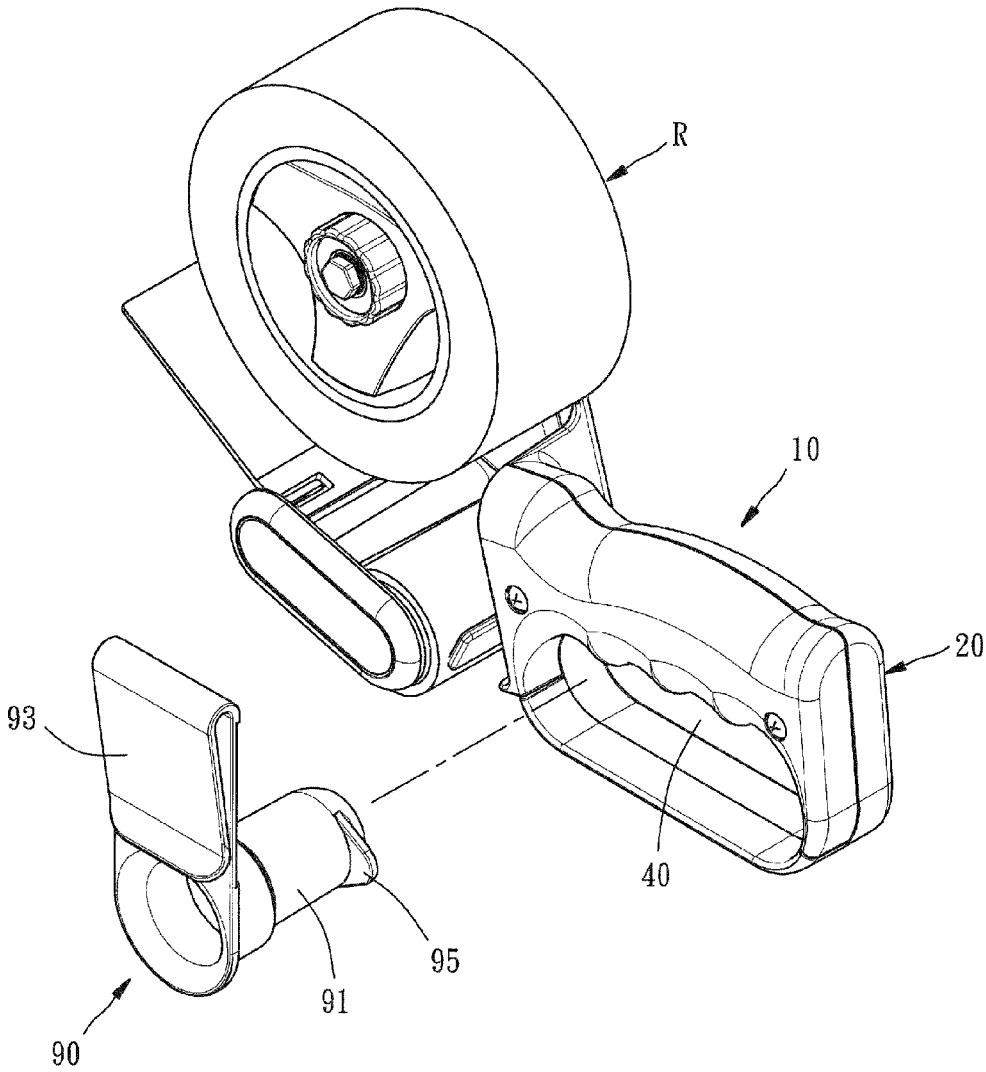
FIG. 6 is an exploded view of a second preferred embodiment of the present invention.

Referring to FIG. 6, an adhesive tape dispenser constructed according to a second embodiment of the present invention is similar to that of the first embodiment, but further having a hanging auxiliary 90. The hanging auxiliary 90 includes a hanging bar 91 inserted into the receiving space 40, specifically into one of the recessed portions 25. The hanging auxiliary 90 is rotatable relative to the main body 10 for a predetermined angle and further includes a hanging portion 93 which can be mounted to a predetermined object. The hanging portion 93 is a hanging loop in this embodiment and can be hung on the user's waist belt.

Figure 7:
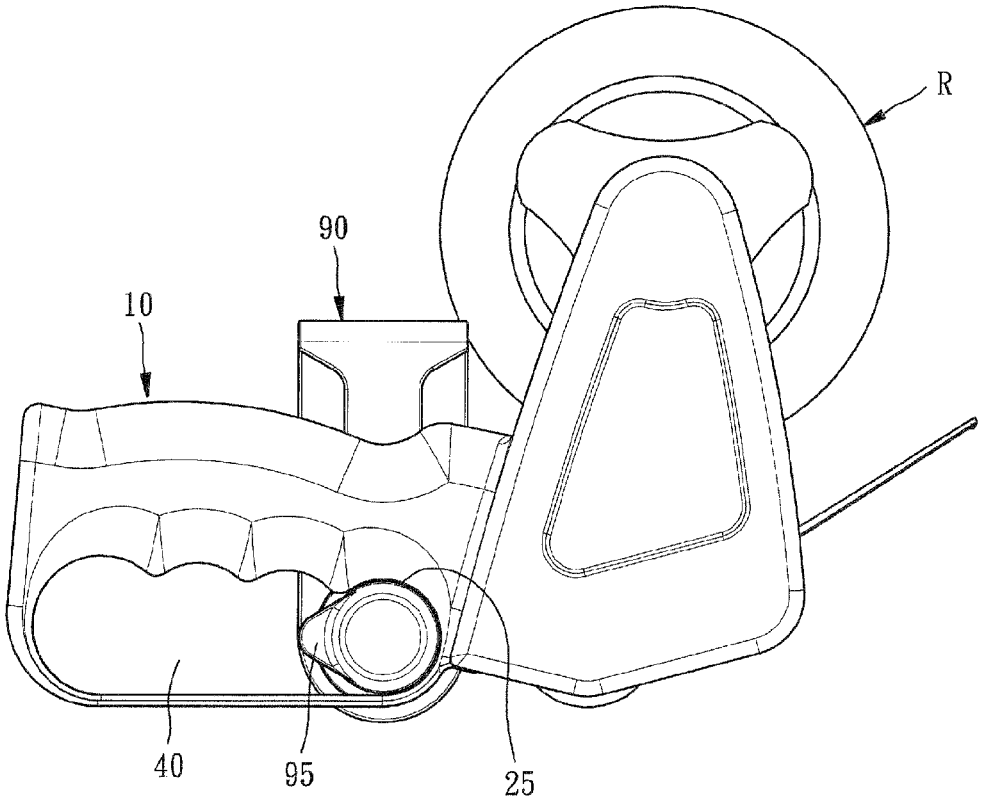
FIG. 7 is a rear view of the second preferred embodiment of the present invention, showing that the stopping portion can engage or disengage from the receiving space.
Figure 8:
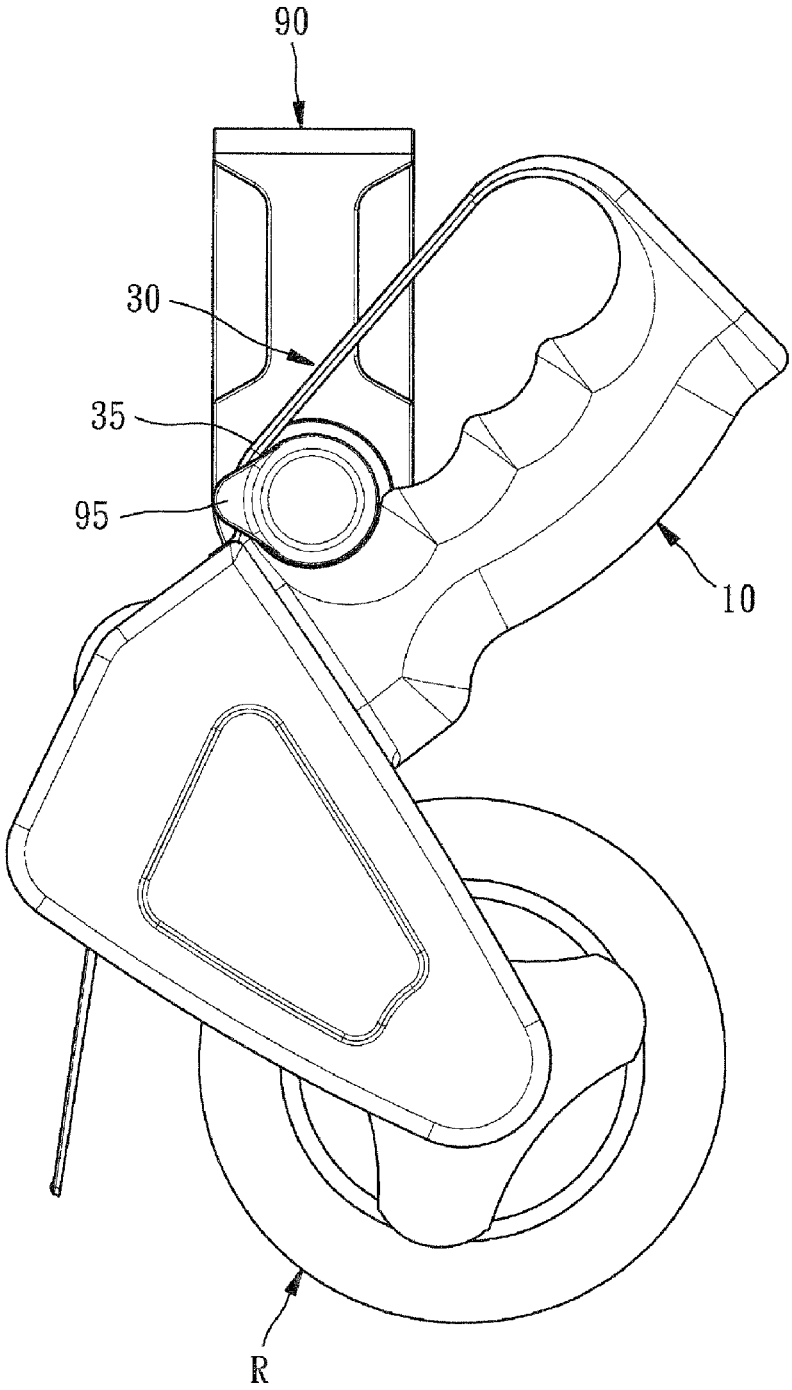
FIG. 8 is a rear view of the second preferred embodiment of the present invention, showing that the stopping portion is stopped against the handgrip.

The hanging auxiliary 90 includes a stopping portion 95, which can be not stopped against the main body 10 at a first angle to allow the hanging auxiliary 90 to separate from the main body 10 or stopped against the main body 10 at a second angle to stop the hanging auxiliary 90 from separation from the main body 10, as shown in FIGS. 7 and 8. When the hanging auxiliary 90 is separable from the main body 10, the stopping portion 95 can insert into or pull out from the receiving space 40. When the hanging auxiliary 90 is inseparable from the main body 10, the stopping portion 95 is stopped against the protective wall 30 or its arc-shaped portion 35.

Therefore, the receiving space 40 formed in the main body 10 can be provided for the user to hang the adhesive tape dispenser while it is not used, such that the adhesive tape dispenser can be more conveniently carried, taken for operation, or hung in reserve.

In addition, the present invention can have the following alternative structures.

First, the protective wall and the handgrip of the main body can be formed in one piece by injection molding via die release.

Second, the protective wall of the main body can be pivoted for a predetermined angle to fit different sizes.

Third, the contact surface of the protective wall can further have a plurality of rolling columns (not shown) or bristles (not shown) thereon for better pre-pressing effect.

Fourth, the protective wall can be adjustable in position and angle to allow the contact surface to more fully lie on and press the object before the adhesive tape is dispensed on it. For example, an elastic member can be also mounted to allow the contact surface to elastically press the object to further provide better pre-pressing effect.

Fifthly, the receiving space of the main body is open at least one side thereof for easy production and elastic deformation of the protective wall.

In conclusion, the adhesive tape dispenser of the present invention can effectively protect the user's hand against injury during the operation and smoothly press the object before the adhesive tape is dispensed on it to allow the adhesive tape to be dispensed smoothly on the object. Besides, the hanging auxiliary allows the adhesive tape dispenser to be portable in such a way that it is very convenient for the user to carry it with him or her or take it out for operation.

What is claimed is:

1. An adhesive tape dispenser on which a tape roll having a roll of adhesive tape is mounted, comprising:

a main body having a handgrip, a protective wall connected with the handgrip and having a contact surface formed at one side thereof opposite to the other side thereof facing the handgrip, and an assembly member, the protective wall and the handgrip jointly defining a receiving space;

a tape roll holder mounted to the assembly member and having a rotatable member for installing the tape roll thereto;

a pressing roller mounted to the main body and having a rolling member which is rotatable relative to the main body for rolling the adhesive tape pulled out of the tape roll; and further comprising a hanging auxiliary, wherein the hanging auxiliary has a hanging bar inserted into the receiving space of the main body.

2. The adhesive tape dispenser as defined in claim 1, wherein the protective wall has front and rear ends, and the protective wall comprises an arc-shaped portion formed at at least one of the front and rear ends thereof.

3. The adhesive tape dispenser as defined in claim 1, wherein the handgrip is composed of a first shell and a second shell, and the protective wall is connected with the first shell.

4. The adhesive tape dispenser as defined in claim 3, wherein the second shell is covered on at least one part thereof by the protective wall.

5. The adhesive tape dispenser as defined in claim 1, wherein the handgrip comprises a plurality of recessed portions formed at one side thereof and abutting against the receiving space.

6. The adhesive tape dispenser as defined in claim 1, wherein the hanging auxiliary comprises a hanging portion for connection with a predetermined object.

7. The adhesive tape dispenser as defined in claim 1, wherein the hanging auxiliary is rotatable relative to the main body for a predetermined angle.

8. The adhesive tape dispenser as defined in claim 7, wherein the hanging auxiliary comprises a stopping portion which can be not stopped against the main body at a first angle to allow the hanging auxiliary to separate from the main body or stopped against the main body at a second angle to stop the hanging auxiliary from separation from the main body.

9. The adhesive tape dispenser as defined in claim 8, wherein the stopping portion can enter into or disengage from the receiving space while the hanging auxiliary is separable from the main body.

* * * * *